United States Patent [19]

Woodard

[11] 4,121,065

[45] Oct. 17, 1978

[54] TOGGLE SWITCH LEVER LOCK

[75] Inventor: Tony O. Woodard, Pine Level, N.C.

[73] Assignee: Cutler-Hammer, Inc., Milwaukee, Wis.

[21] Appl. No.: 846,682

[22] Filed: Oct. 31, 1977

[51] Int. Cl.[2] ..... H01H 3/20; H01H 9/20

[52] U.S. Cl. ..... 200/42 T; 74/528; 74/536; 200/321; 200/322

[58] Field of Search ..... 200/42 R, 42 T, 44, 200/318, 321, 322, 325, 339, 67 G; 74/519, 520, 527, 528, 532, 536, 566, 534

[56] References Cited

U.S. PATENT DOCUMENTS

| | | | |
|---|---|---|---|
| 2,409,022 | 10/1946 | Diedring | 74/566 X |
| 2,510,122 | 6/1950 | Lomholt | 74/536 |
| 2,723,571 | 11/1955 | Koenig | 74/566 X |
| 2,885,905 | 5/1959 | Larkin | 200/322 X |
| 3,001,417 | 9/1961 | Becker et al. | 74/528 |
| 3,316,370 | 4/1967 | Ardizzi | 200/67 G |
| 3,546,409 | 12/1970 | Robbins | 200/325 X |
| 3,604,868 | 9/1971 | Batcheller et al. | 200/42 T |

FOREIGN PATENT DOCUMENTS

| | | | |
|---|---|---|---|
| 685,563 | 4/1964 | Canada | 200/322 |

*Primary Examiner*—Stephen Marcus

*Attorney, Agent, or Firm*—Hugh R. Rather; William A. Autio; Michael E. Taken

[57] ABSTRACT

An off-lock for a toggle switch of the type having a slotted guide plate and a spring-biased toggle lever having flats on opposite sides of the portion thereof extending through the elongated slot in the guide plate to confine the toggle lever for non-rotatable pivotal motion. The lever lock consists of arcuate grooves around the toggle lever slightly above the guide plate deep enough to allow rotation of the toggle lever after it is pressed down to bring such grooves to the level of the guide plate. For off-lock in its center off position, the toggle lever is pressed down against the force of the plunger springs and turned 90° so as to cause the opposite edges of the slot in the guide plate to mesh with the arcuate grooves and thus lock the toggle lever against pivotal movement. To release the off-lock, the toggle lever is turned 90° whereupon it snaps up to normal position allowing pivotal movement.

8 Claims, 5 Drawing Figures

Fig. 1
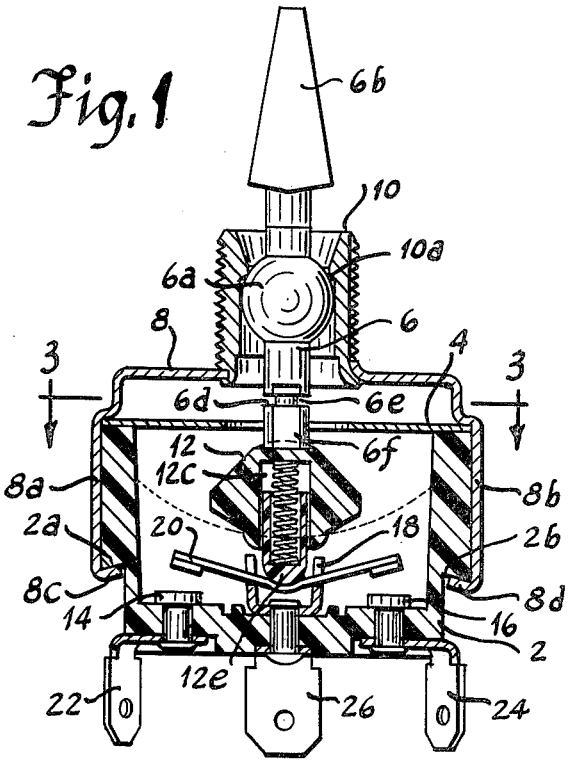
Fig. 5
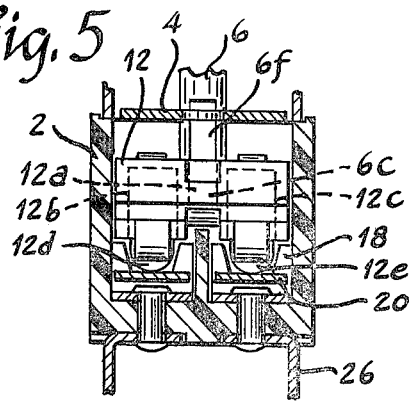
Fig. 2
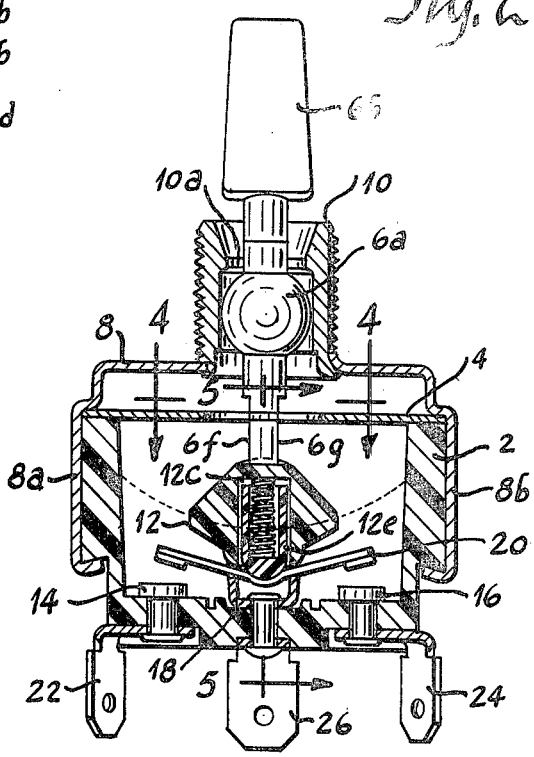
Fig. 3
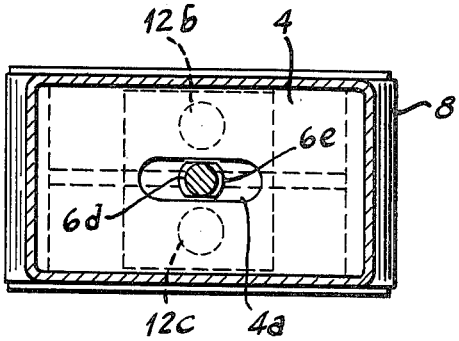
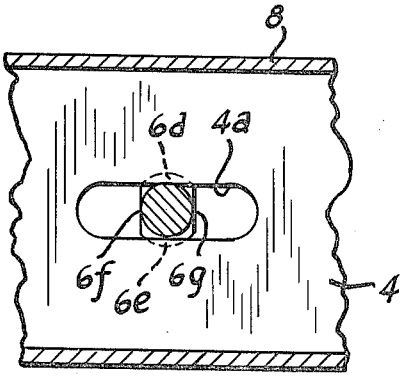
Fig. 4

TOGGLE SWITCH LEVER LOCK

BACKGROUND OF THE INVENTION

Toggle switch lever locks have been known heretofore. For example, British Pat. No. 964,888, dated July 22, 1964, owned by the assignee of this invention, discloses a lever lock wherein a two-tooth spring-biased detent sleeve on the toggle lever catches into a pair of notches at the top of the bushing to lock the pivotal toggle lever in a selected position depending upon the contour of the outer end of the bushing. To release the lock the knob capping the detent sleeve is grapsed and pulled up to lift the teeth from the notches and allow pivotal actuation of the toggle lever.

While such prior lever lock has been useful for its intended purposes, this invention relates to improvements thereover.

SUMMARY OF THE INVENTION

An object of the invention is to provide an improved toggle switch lever lock.

A more specific object of the invention is to provide an improved toggle lever off-lock.

Another specific object of the invention is to provide an improved toggle lever off-lock that requires minimum modification of a conventional non-locking toggle switch.

Another specific object of the invention is to provide an improved center-position off-lock for a spring-biased toggle lever.

Another specific object of the invention is to provide an improved pivotal lever center position lock that is simple and economical to manufacture and effective in operation.

Other objects and advantages of the invention will hereinafter appear.

BRIEF DESCRIPTION OF THE DRAWINGS

FIG. 1 is an enlarged vertical cross-sectional view of a toggle switch according to the invention, this cross-section being taken through the center at the upper portion to show the slot in the guide plate and the toggle lever in its unlocked position and being taken through one side at its lower portion to show the actuator plunger and one contact set of the double-pole double-throw switch;

FIG. 2 is a cross-sectional view like FIG. 1 with the difference that the toggle lever is shown in its locked position;

FIG. 3 is a horizontal cross-sectional view taken along line 3—3 of FIG. 1 to show the slot in the guide plate and the locking grooves in the toggle lever in unlocked position;

FIG. 4 is a partial horizontal cross-sectional view taken along line 4—4 of FIG. 2 to show the slot in the guide plate and the locking grooves in the toggle lever in locked position; and FIG. 5 is a partial vertical cross-sectional view taken along line 5—5 of FIG. 2 to show the double-pole contact actuator and the toggle lever coupled thereto.

DESCRIPTION OF THE BEST MODE

Referring to FIGS. 1-5 of the drawings, there is shown an illustration of the best mode contemplated for carrying out the invention. As shown therein, the toggle lever lock is applied to a toggle lever switch of the double-pole double-throw type although it is equally applicable to toggle lever switches of other types such as single-pole or multiple-pole types or to pivotal lever operated devices of other types.

The switch illustrated comprises an open-top insulated housing or base 2, a metal guide plate 4 overlying the open top of the base, a metal toggle lever 6 extending up through an elongated slot **4*a* in the guide plate, a metal frame 8 secured to the base for clamping the guide plate to the top of the base and having an upstanding bushing 10 secured in a hole therein for supporting the toggle lever for pivotal movement, and an insulating contact actuator 12** coupled to the lower end of the toggle lever for closing and opening the contacts hereinafter described.

The double-pole double-throw contacts include two sets of contacts with three stationary contacts and one movable bridging contact in each set, one such set of contacts being shown in FIGS. 1 and 2. As shown therein, there are three spaced stationary contacts secured in a row in the bottom of the base including first and third like contacts 14 and 16 and a second, center cradle contact 18 that supports a rockable movable contact 20 capable of bridging the center contact to either the first or the third stationary contact according to which direction the toggle lever is pivoted. These three stationary contacts are connected through holes in the bottom of the base to respective external terminals 22, 24 and 26 as shown in FIGS. 1 and 2.

As shown in FIGS. 3 and 4, slot **4*a* is oriented centrally in guide plate 4 and aligned in the plane of pivotal movement of the toggle lever. This slot 4*a*** is elongated in such plane and generally rectangular in form except that its corners may be rounded as shown.

Base 2 is provided with undercuts **2*a* and 2*b* at its ends for retaining the metal frame secured to the base. For this purpose, frame 8 is provided with a pair of downwardly extending flaps or skirts 8*a* and 8*b*, each having a pair of tabs, 8*c* and 8*d*, at its lower corners that are bent below undercuts 2*a* and 2*b*, respectively, to secure the frame to the base. The top of the frame is offset upwardly from guide plate 4** to provide space for momentary spring mechanism or the like if desired.

Bushing 10 is provided with means for pivotally retaining the toggle lever and preventing it from moving upwardly therein but allowing downward movement of the toggle lever against the force of the plunger springs. This means comprises an annular constriction **10*a* within the bore of the bushing near the top thereof that provides a pivotal seat for enlarged spherical portion 6*a* of the toggle lever. Toggle lever 6 which is made of metal such as brass or the like is preferably provided with an insulating plastic cap or outer handle portion 6*b*** that is telescoped over the reduced upper end portion of the lever and rigidly joined thereto by serrations, sharp teeth or the like that bite into the plastic when the handle portion is pressed thereon.

As shown in FIG. 5, the lower end of the toggle lever is coupled to the center of the contact actuator. For this purpose, the toggle lever has a reduced diameter, round, lower end portion **6*c* that fits into a hole 12*a* in contact actuator 12 to couple the latter for movement when the toggle lever is pivoted to the left or right. The contact actuator is provided on opposite sides of the toggle lever hole with a pair of upwardly extending plunger holes 12*b* and 12*c* shown in broken lines in FIGS. 3 and 5 for retaining a pair of spring-biased plungers 12*d* and 12*e*** that press down against the respective movable contacts and slide therealong to actuate the same when the toggle lever is operated.

To provide the lever off-lock, all that is needed is to add two arcuate grooves 6*d* and 6*e* on the toggle lever as shown in FIGS. 1 and 4. Normally, the lower portion of the toggle lever where it passes through the slot in the guide plate has a pair of flats 6*f* and 6*g* as shown in FIGS. 2 and 4 on opposite sides of the round lever. These flats reduce the width of the lever to the width of the guide slot so that the long edges of the slot retain the lever non-rotatable for pivotal movement and thus retain handle portion 6*b* properly oriented for switch operation. Arcuate grooves 6*d* and 6*e* join the two flat sides 6*f* and 6*g* a predetermined distance or spacing above the guide plate as shown in FIG. 1. This predetermined distance is equal or substantially equal to the distance that the toggle lever can be pressed downward against the forces of the plunger springs causing actuator 12 to abut against the movable contacts.

In order to lock the toggle lever in its center off position, the toggle lever is depressed all the way so that actuator 12 abuts the movable contacts. In this condition, grooves 6*d* and 6*e* are aligned with the opposite long edges of guide plate slot 4*a*. The toggle lever is then turned a quarter turn so that the edges of the slot enter into and mesh with grooves 6*d* and 6*e*. The toggle lever may then be released and it will remain in such depressed position as shown in FIG. 2.

If an attempt is now made to pivot the toggle lever from the center position shown in FIG. 2 to the left or right, the plunger will start to slide along the movable contact and attempt to climb over the hump in the movable contact directly over the side of cradle contact 18. This causes the plunger springs to be compressed all the way so that the upper ends of the plungers stop against the upper ends of their holes in the contact actuator before the lower ends of the plungers have slid out of the cradle area of the movable contact. This causes a lock-up with the contacts remaining open. For this purpose, the lower end portion of the toggle lever below grooves 6*d* and 6*e*, and contact actuator 12 along with its plungers 12*b* and 12*c* are rigidly confined between guide plate 4 and movable contact 20. In this state, the contact actuator or its plungers cannot move down and the toggle lever cannot move up, at least one of which motions would be required to allow further pivotal action, and as a result the operation becomes locked. Also, the edges of slot 4*a* are confined in grooves 6*d* and 6*e* to prevent pivotal motion of the toggle lever whereby the operation becomes locked. Upon release of the toggle lever handle, the contact actuator and toggle lever return to the center position shown in FIG. 2 under the force of the two plunger springs.

To release the lock, the toggle lever is turned 90° to align flats 6*f* and 6*g* with the edges of slot 4*a* whereupon the plunger springs snap the toggle lever back up to the position shown in FIG. 1 free of the guide plate allowing normal operation of the switch to close the contacts.

While the apparatus hereinbefore described is effectively adapted to fulfill the objects stated, it is to be understood that the invention is not intended to be confined to the particular preferred embodiment of toggle switch lever lock disclosed, inasmuch as it is susceptible of various modifications without departing from the scope of the appended claims.

I claim:

1. A lockable toggle lever operated device comprising: a pivoted toggle lever having a handle portion at its upper end;

a support comprising a bushing providing a pivot supporting said toggle lever at an intermediate portion thereof extending through the bore of said bushing for pivotal movement to operate said device;

an actuator at the lower end of said toggle lever comprising a spring-biased plunger engaging said device and biasing said toggle lever up against said pivot while allowing limited depression thereof against the force of said spring-biased plunger;

lever guiding means comprising flat surfaces on first opposite sides of said toggle lever and a guide plate mounted to said support having an elongated slot cooperating with said flat surfaces to guide said toggle lever for non-rotatable pivotal movement in one plane while allowing said limited depression thereof;

and lever locking means comprising interference means on the other opposite sides of said toggle lever normally above said guide plate and being operative following depression of said toggle lever and a quarter turn rotation thereof for providing locking interference between said interference means and the edges of said slot to prevent pivotal movement of said toggle lever out of its center position.

2. A lockable toggle lever operated device comprising:

a pivotal toggle lever having a handle at its upper end;

a support comprising a bushing providing a pivot supporting said toggle lever below said handle for pivotal movement to operate said device;

an actuator coupled to the lower end of said toggle lever comprising spring-biased means biasing said toggle lever up against said pivot while allowing limited depression thereof against the force of said spring-biased means;

lever guiding means comprising flat surfaces on opposite sides of said toggle lever and means mounted to said support providing parallel guiding edges cooperating with said flat surfaces to guide said toggle lever for non-rotatable pivotal movement in one plane while allowing said limited depression thereof;

and lever locking means comprising grooves in said toggle lever connecting said flat surfaces and spaced from said guiding edges so that depression of said toggle lever against the force of said spring-biased means and rotation thereof a quarter turn causes said guiding edges to enter said grooves to retain said toggle lever in its depressed state and locked against pivotal movement.

3. The lockable toggle lever operated device claimed in claim 2, wherein:

said spring-biased means engages said device;

and said grooves are spaced above said guiding edges a distance requiring full depression of said toggle lever so that said actuator engages said device thereby to trap that portion of said toggle lever below said grooves and said actuator between said parallel guiding edge means and said device to prevent pivotal movement of said toggle lever.

4. A lockable toggle lever switch comprising:

a pivotal toggle lever having a handle at its external end and arranged to pivot from its center position in at least one direction;

a housing comprising an electrically insulating base and a frame connected thereto;

said frame having a bushing including a bore with means therein pivoting said toggle lever at an intermediate point for movement to operate said switch;

stationary contact means within said housing connected through said base to external terminals;

movable contact means within said housing selectively operable to "on" position closing a circuit with respect to said stationary contact means or to "off" position opening said circuit;

a contact actuator coupled to the lower end of said toggle lever comprising spring-biased means engaging said movable contact means and biasing said toggle lever up against said pivoting means while allowing limited downward depression thereof against the force of said spring-biased means;

lever guiding means comprising flat portions on opposite sides of said toggle lever and means mounted within said housing providing parallel edges coacting with said flat portions to confine the pivotal movement of said toggle lever to one plane while preventing rotary movement thereof on its longitudinal axis while allowing said limited depression thereof;

and lever locking means comprising a pair of grooves in said toggle lever extending between said flat portions and normally spaced above said parallel edges of said lever guiding means affording rotation of said toggle lever a quarter turn on its longitudinal axis, following depression of said toggle lever against the force of said spring-biased means enough to lower said grooves to the level of said parallel edges of said lever guiding means, thereby to cause said guiding edges to enter said grooves and to lock said toggle lever against pivotal movement from said center position.

5. The lockable toggle lever switch claimed in claim 4, wherein:

the thickness of said toggle lever between said flat portions is slightly less than the spacing between said parallel edges to allow free swinging movement of said toggle lever without rotation on its longitudinal axis;

and said pair of grooves are arcuate grooves joining the edges of said flat portions and having a diameter therebetween substantially equal to said thickness of said toggle lever between said flat portions to afford unimpeded rotation of said toggle lever after it has been depressed.

6. The lockable toggle lever switch claimed in claim 4, wherein:

said means mounted within said housing providing parallel edges comprises a guide plate clamped between said base and frame and having an elongated slot therein with its long edges forming said parallel edges.

7. The lockable toggle lever switch claimed in claim 6, wherein:

said contact actuator comprising spring-biased means comprises an actuator block coupled of the lower end of said toggle lever and having a plurality of spring-biased plungers extending downwardly therefrom into engagement with said movable contact means;

and said pair of grooves are spaced above said parallel edges far enough to require full depression of said toggle lever until said actuator block engages said contact means in order to lower said grooves to the level of said parallel edges so that, following a quarter turn of said toggle lever, the part of said toggle lever below said grooves and said actuator block are trapped between said guide plate and said contact means to prevent pivotal operation of said toggle lever.

8. The lockable toggle lever switch claimed in claim 4, wherein:

said grooves have a width snugly to receive said parallel edges of said lever guiding means to prevent significant tilting of said toggle lever with respect thereto thereby to restrain operation of said contact means.

* * * * *